US011181867B2

(12) United States Patent
Hitsumoto

(10) Patent No.: US 11,181,867 B2
(45) Date of Patent: Nov. 23, 2021

(54) PUSH BUTTON AND TIMEPIECE

(71) Applicant: CASIO COMPUTER CO., LTD., Tokyo (JP)

(72) Inventor: Shin Hitsumoto, Koganei (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 115 days.

(21) Appl. No.: 16/591,831

(22) Filed: Oct. 3, 2019

(65) Prior Publication Data

US 2020/0110365 A1 Apr. 9, 2020

(30) Foreign Application Priority Data

Oct. 3, 2018 (JP) ..... JP2018-188317

(51) Int. Cl.
*G04B 37/10* (2006.01)
*G04B 3/00* (2006.01)
(Continued)

(52) U.S. Cl.
CPC ..... *G04B 37/106* (2013.01); *G04B 3/001* (2013.01); *G04B 3/048* (2013.01); *G04B 13/021* (2013.01)

(58) Field of Classification Search
CPC ..... G04B 37/106; G04B 3/001; G04B 3/048; G04B 13/021; G04C 3/001; G04C 3/005; H01H 13/12; H01H 2300/016
(Continued)

(56) References Cited

U.S. PATENT DOCUMENTS 4,007,347 A * 2/1977 Haber ..... G04C 3/005 200/530
4,364,674 A * 12/1982 Tesch ..... G04B 37/106 368/308
(Continued)

FOREIGN PATENT DOCUMENTS

CN 1445627 A 10/2003
CN 204790342 U 11/2015
(Continued)

OTHER PUBLICATIONS

First Office Action dated Jun. 23, 2021 received in Chinese Patent Application No. CN 201910893452.X together with an English language translation.

*Primary Examiner* — Edwin A. Leon
(74) *Attorney, Agent, or Firm* — Scully Scott Murphy & Presser

(57) ABSTRACT

A push button capable of improving shock resistance and a timepiece equipped therewith are provided. This push button includes an operation member having a shaft section inserted into a through hole of a case and a head section provided on the outer end of the shaft section, and an elastic member which presses the head section toward the outside of the case or is elastically deformed, and this elastic member includes a buffer section that buffers a pressure externally applied to the head section which is greater than a predetermined pressure. Accordingly, when a pressure greater than the predetermined pressure is applied to the head section, the head section comes in contact with the buffer section while elastically deforming the elastic member so as to buffer the pressure. By this structure, shock resistance is improved.

13 Claims, 9 Drawing Sheets

(51) Int. Cl.
*G04B 3/04* (2006.01)
*G04B 13/02* (2006.01)

(58) Field of Classification Search
USPC ..... 368/290
See application file for complete search history.

(56) References Cited

U.S. PATENT DOCUMENTS 5,631,881 A * 5/1997 Pessey ..... G04C 3/001
368/290
2003/0174590 A1 * 9/2003 Arikawa ..... G04B 37/106
368/319

FOREIGN PATENT DOCUMENTS

CN 207558674 U 6/2018
JP 2002-352662 A 12/2002

* cited by examiner

PUSH BUTTON AND TIMEPIECE

CROSS-REFERENCE TO RELATED APPLICATION

This application is based upon and claims the benefit of priority from the prior Japanese Patent Application No. 2018-188317, filed Oct. 3, 2018, the entire contents of which are incorporated herein by reference.

BACKGROUND

1. Technical Field

The technical field relates to a push button and a timepiece equipped with the push button.

2. Description of the Related Art

For example, a switch device for a wristwatch is known which has a structure where a pipe is fitted into a through hole provided stepwise in a wristwatch case, a shaft section of an operation member is slidably inserted into the pipe, a cylindrical resilient member is arranged between a head section of the operation member and the pipe, and a switch element is operated by the resilient member being resiliently deformed and the shaft section being slid in response to a depression operation performed on the head section of the operation member, as shown in Japanese Patent Application Laid-Open (Kokai) Publication No. 2002-352662.

In this type of switch device, there is a risk that, when a pressure higher than a predetermined pressure is externally applied to the head section of the operation member, the head section collides with the stepped portion in the through hole of the wristwatch case, and whereby the head section, the wristwatch case, or the switch element is damaged.

SUMMARY

One embodiment discloses a push button and a timepiece equipped with the push button.

In accordance with one aspect of one embodiment, there is provided a push button comprising: a case provided with a through hole; an operation member including a shaft section inserted into the through hole and a head section provided on an outer end of the shaft section; and an elastic member which presses the head section toward outside of the case or is elastically deformed, wherein the elastic member includes a buffer section which comes in contact with the head section and is elastically deformed when a pressure greater than a predetermined pressure is applied to the head section from outside.

The above and further objects and novel features of one embodiment will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment of a wristwatch will hereinafter be described with reference to FIG. 1 to FIG. 6.

Figure 1:
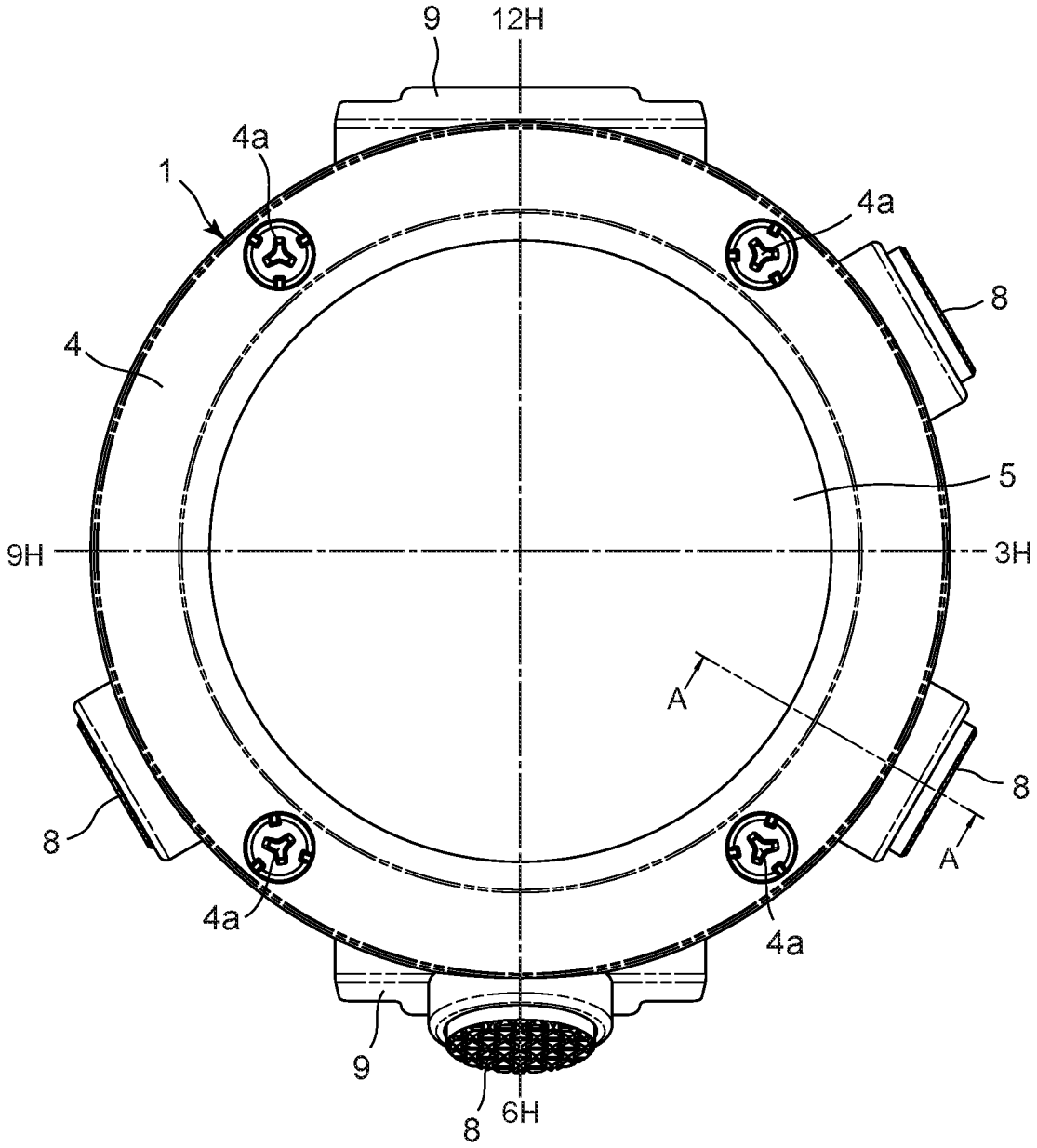
FIG. 1 is a front view of a wristwatch that is an embodiment.
Figure 2:
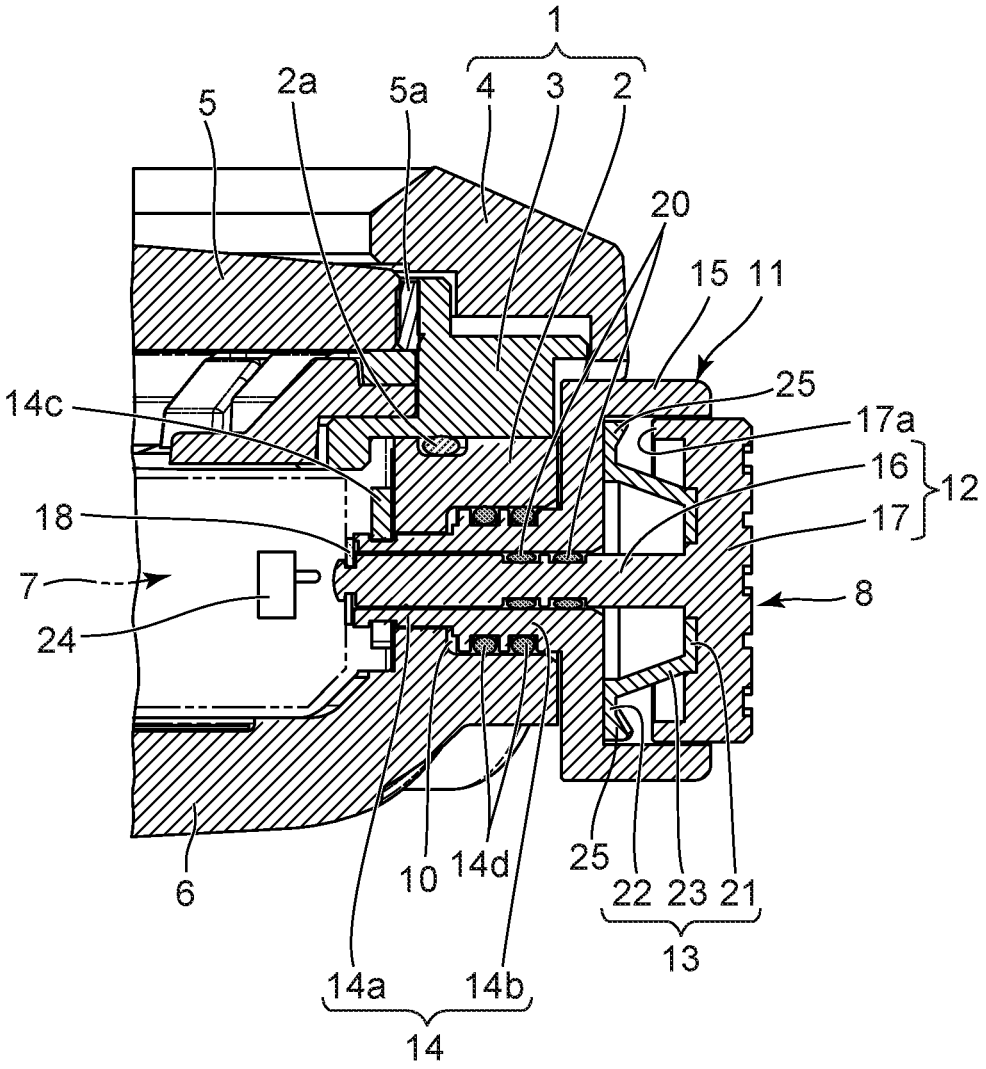
FIG. 2 is an enlarged sectional view of a main portion of the wristwatch taken along line A-A in FIG. 1.
Figure 3:
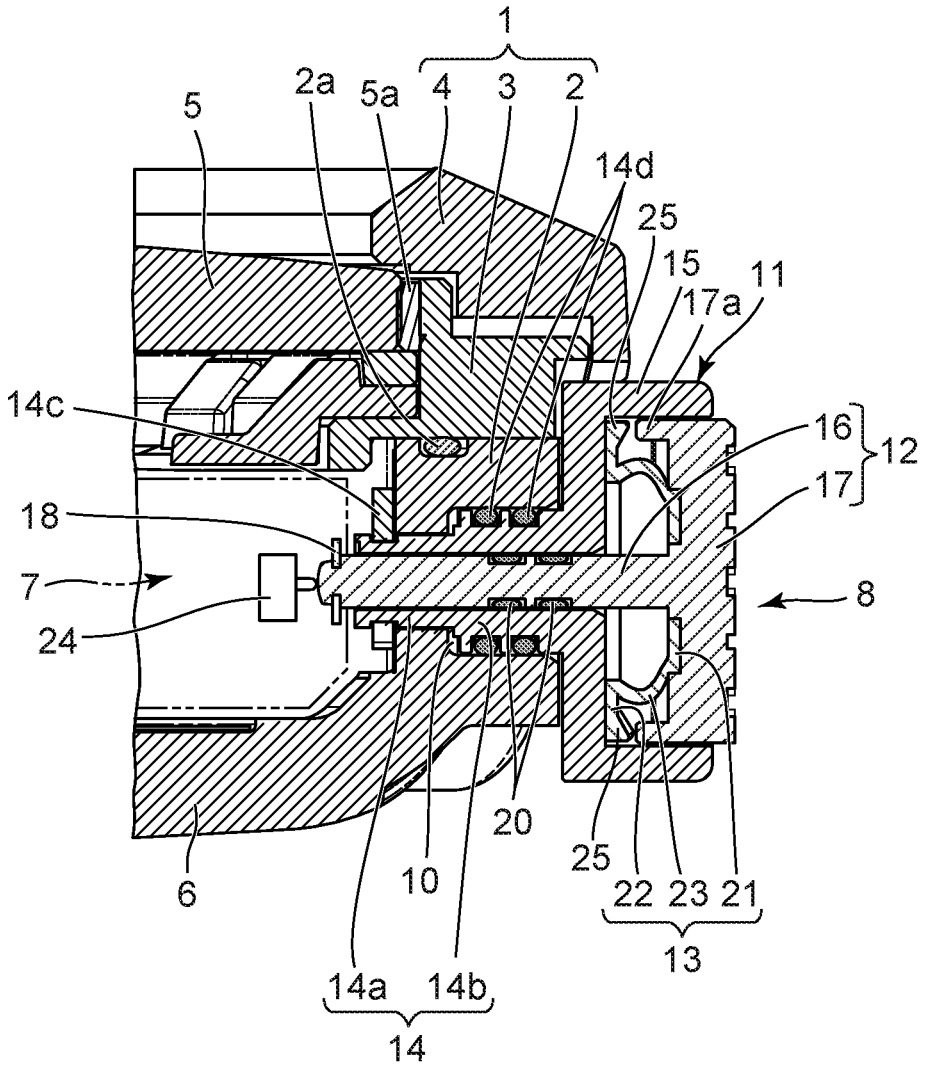
FIG. 3 is a sectional view where an operation member for a push button shown in FIG. 2 has been pressed.

This wristwatch has a wristwatch case 1, as shown in FIG. 1 to FIG. 3. The wristwatch case 1 includes a first case 2, a second case 3 provided on the upper part of the first case 2 via a waterproof ring 2*a*, and an exterior member 4 attached to the outer circumferences of the first case 2 and the second case 3 by screws 4*a* so as to cover them.

The first and second cases 2 and 3 are formed of metal or hard synthetic resin, and the exterior member 4 is formed of soft synthetic resin such as urethane resin. To the upper opening of the wristwatch case 1, that is, to the upper opening of the second case 3, a watch glass 5 is attached via a packing 5*a*.

Also, to the bottom of the wristwatch case 1, that is, to the bottom of the first case 2, a back cover 6 is attached, as shown in FIG. 2 and FIG. 3. Note that a structure may be adopted in which this back cover 6 is attached to the bottom of the first case 2 via a waterproof ring.

Inside the wristwatch case 1, that is, inside the first and second cases 2 and 3, a timepiece module 7 is arranged, as shown in FIG. 2 and FIG. 3. This timepiece module 7 has various components which are not shown in the drawings but are necessary for timepiece functions, such as a timepiece movement for driving hands to indicate the time, a display section for displaying information including time information, a switch element 24 described later, and a circuit section for electrically driving and controlling these sections.

On side portions on the twelve o'clock side and six o'clock side of the wristwatch case 1, band attachment sections 9 where a watch band (not shown) is attached are provided, as shown in FIG. 1. Also, on side portions on the two o'clock side, four o'clock side, six o'clock side, and eight o'clock side of the wristwatch case 1, push buttons 8 are provided, respectively.

Among these plurality of push buttons 8, for example, the push button 8 located on the four o'clock side includes a cylindrical member 11 fitted into a through hole 10 provided in the first case 2 of the wristwatch case 1, an operation member 12 slidably inserted into the cylindrical member 11, and an elastic member 13 which forces the operation member 11 toward the outside of the wristwatch case 1, as shown in FIG. 2 and FIG. 3.

The cylindrical member 11 includes a first cylinder section 14 that is inserted into the through hole 10 of the first case 2 and a second cylinder section 15 that is provided on the outer end of the first cylinder section 14 and arranged outside the first case 2, which are formed of metal such as stainless steel or titanium or hard synthetic resin, as shown in FIG. 2 and FIG. 3.

The first cylinder section 14 includes a small-diameter cylinder section 14*a* that is inserted into a small-diameter hole portion of the through hole 10 and a large-diameter cylinder section 14*b* that is inserted into a large-diameter hole portion of the through hole 10, as shown in FIG. 2 and FIG. 3. This first cylinder section 14 is formed such that the length of the small-diameter cylinder section 14*a* in the axial direction and that of the large-diameter cylinder section 14*b* are substantially equal to each other.

The small-diameter cylinder section 14*a* of the first cylinder section 14 is formed such that its outer diameter is substantially equal to the inner diameter of the small-diameter hole portion of the through hole 10 and its length in the axial direction is longer than that of the small-diameter hole portion of the through hole 10, as shown in FIG. 2 and FIG. 3.

The inner end of the small-diameter cylinder section 14*a* of the first cylinder section 14 protrudes inside the first case 2, as shown in FIG. 2 and FIG. 3. To this protruding inner end portion of the small-diameter cylinder section 14*a*, a stopper member 14*c* such as an E-ring is attached. Accordingly, the cylindrical member 11 is prevented from slipping from the through hole 10 toward the outside of the wristwatch case 1.

On the other hand, the large-diameter cylinder section 14*b* has a plurality of annular waterproof rings 14*d* provided on its outer circumference, and is inserted into the large-diameter hole portion of the through hole 10 with these waterproof rings 14*d* being in contact with the inner circumference of the large-diameter hole portion, as shown in FIG. 2 and FIG. 3. As a result, waterproofing between the outer circumference surface of the large-diameter cylinder section 14*b* and the inner circumference surface of the large-diameter hole portion of the through hole 10 is maintained.

The second cylinder section 15 is formed such that its outer diameter is longer than the length of the first case 2 in the vertical direction and shorter than the length from the upper part of the second case 3 to the undersurface of the back cover 6, as shown in FIG. 2 and FIG. 3. Also, this second cylinder section 15 is formed such that its length in the axial direction is shorter than the length of the first cylinder section 14 in the axial direction and longer than the length of the large-diameter cylinder section 14*b* of the first cylinder section 14 in the axial direction. Moreover, this second cylinder section 15 is formed such that its inner diameter is sufficiently larger than the inner diameter of the first cylinder section 14 and substantially equal to or slightly longer than the length of the first case 2 in the vertical direction.

The operation member 12 includes a shaft section 16 that is slidably and rotatably inserted into the first cylinder section 14 of the cylindrical member 11, and a head section 17 that is provided on the outer end of the shaft section 15 and slidably and rotatably arranged in the second cylinder section 15 of the cylindrical member 11, as shown in FIG. 2 and FIG. 3.

The shaft section 16 of the operation member 12 is formed of metal such as stainless steel and titanium or hard synthetic resin in a round stick shape, and its outer diameter is substantially equal to the inner diameter of the first cylinder section 14 of the cylindrical member 11, as shown in FIG. 2 and FIG. 3. The length of this shaft section 16 in the axial direction is substantially equal to or slightly longer than the length of the cylindrical member 11 in the axial direction.

As a result, the shaft section 16 of the operation member 12 has a structure where its outer end side protrudes inside the second cylinder section 15, its inner end protrudes inside the first case 2, and a stopper member 18 such as an E-ring is attached to the protruding inner end portion, as shown in FIG. 2 and FIG. 3. Accordingly, by the stopper member 18, the shaft section 16 is prevented from slipping from the cylindrical member 11 toward the outside of the wristwatch case 1.

On the outer circumference surface of the shaft section 16 of the operation member 12, a plurality of annular packing members 20 are provided, as shown in FIG. 2 and FIG. 3. These packing members 20 maintain waterproofing between the outer circumference surface of the shaft section 16 and the inner circumference surface of the first cylinder section 14 by their outer circumference portions coming in contact with the inner circumference surface of the first cylinder section 14.

The head section 17 of the operation member 12 is made of metal such as stainless steel and titanium or hard synthetic resin as with the shaft section 16, and has a discoid shape, as shown in FIG. 2 and FIG. 3. This head section 17 is provided on the outer end of the shaft section 16. Also, this head section 17 is formed such that its outer diameter is substantially equal to the inner diameter of the second cylinder section 15 of cylindrical member 11 and its length in the axial direction is substantially equal to the axial direction length of the inner area of the second cylinder section 15. As a result, the head section 17 is retractable from the second cylinder section 15.

Figure 4:
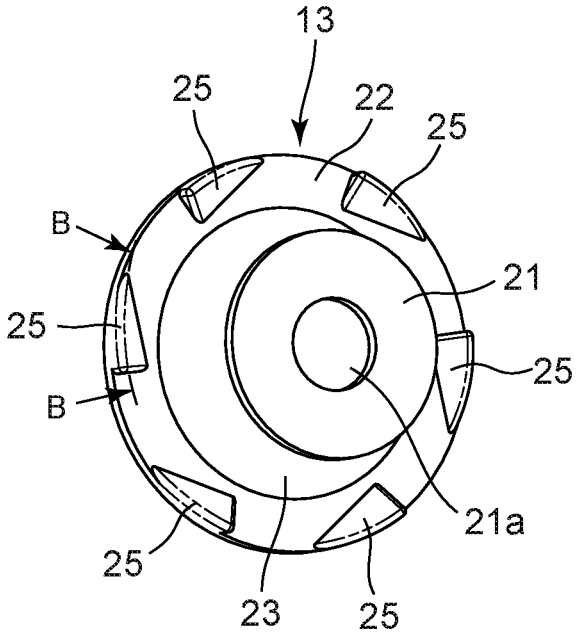
FIG. 4 is a perspective view of an elastic member for the push button shown in FIG. 2.

The elastic member 13 is formed of elastic material that is elastomer such as silicone rubber or urethane rubber, as shown in FIG. 2 to FIG. 4. Note that the elastic member 13 should preferably be formed of silicone rubber which is excellent in environment resistance and chemical resistance and whose mechanical characteristics are stable in a wide temperature range. This elastic member 13 presses the head section 17 of the operation member 12 toward the outside of the wristwatch case 1, or is deformed in accordance with pressure applied to the head section 17 by the slide movement of the operation member 12.

The above-described elastic member 13 includes a first surface section 21 which has a discoid shape and comes in elastic contact with the inner surface of the head section 17 of the operation member 12, a second surface section 22 which has a brim shape and comes in elastic contact with the inner surface of the second cylinder section 15 of the cylindrical member 11, and a cylindrical elastic deformation section 23 which has a shape that gradually widens toward the second surface section 22 and connects the first surface section 21 and the second surface section 22, as shown in FIG. 2 to FIG. 4.

The first surface section 21 having a discoid shape is formed such that its outer diameter is substantially equal to or slightly longer than that of the large-diameter cylinder section 14*b* of the first cylinder section 14 of the cylindrical member 11, as shown in FIG. 2 to FIG. 4. This first surface section 21 has an insertion hole 21*a* provided in its center portion where the shaft section 16 is inserted, and comes in contact with the inner surface of the head section 17. In this embodiment, on the inner surface of the head section 17, a groove portion for positioning the first surface section 21 is provided. By being fitted into and arranged in this groove portion, the first surface section 21 can continue being in contact with substantially the same area on the inner surface of the head section 17 even when pressure is externally applied to the head section 17. That is, the contact area of the head section 17 and the first surface section 21 is fixed and substantially the same between when pressure is externally applied to the head section 17 and when no pressure is applied thereto. As a result, the elastic member 13 can be elastically and evenly deformed when pressure is externally applied to the head section 17.

On the other hand, the outer diameter of the second surface section 22 is substantially equal to the inner diameter of the second cylinder section 15 of the cylindrical member 11, the inner diameter of the second surface section 22 is longer than the outer diameter of the large-diameter cylinder section 14*b* of the first cylinder section 14, that is, the outer diameter of the first surface section 21, as shown in FIG. 2 to FIG. 4. This second surface section 22, which has a ring shape whose inner diameter is shorter than the length of the first case 2 in the vertical direction, is provided on the side opposite to the first surface section 21 on the elastic member 13, and comes in contact with the inner surface of the second cylinder section 15 of the cylindrical member 11. Accordingly, even when pressure is externally applied to the head section 17, the second surface section 22 continues being in contact with the inner surface of the second cylinder section 15 of the cylindrical member 11 along the inner circumference of the second cylinder section 15 of the cylindrical member 11. That is, the contact area of the second cylinder section 15 and the second surface section 22 is fixed and substantially the same between when pressure is externally applied to the head section 17 and when no pressure is applied thereto. As a result, the elastic member 13 can be elastically and evenly deformed when pressure is externally applied to the head section 17.

The elastic deformation section 23 connects the outer circumference portion of the first surface section 21 and the inner circumference portion of the second surface section 22, as shown in FIG. 2 to FIG. 4. That is, this elastic deformation section 23 has a cylindrical shape whose outer diameter and inner diameter on the second surface section 22 side are larger than those on the first surface section 21 side. By the first surface section 21 being continuously in contact with the same area on the inner surface of the head section 17 and the second surface section 22 being continuously in contact with substantially the same area on the inner surface of the second cylinder section 15 regardless of whether or not pressure has been applied to the head section 17 from outside, this elastic deformation section 23 can be elastically and evenly deformed when pressure is externally applied to the head section 17, whereby the pressure externally applied to the head section 17 is evenly dissipated and the operation member 12 can be easily operated.

The elastic member 13 has a structure which presses the head section 17 of the operation member 12 toward the outside of the wristwatch case 1 by the elastic force of the elastic deformation section 23, as shown in FIG. 2 to FIG. 4.

Also, this elastic member 13 has a structure in which, when the head section 17 of the operation member 12 is pressed toward the outside of the wristwatch case 1 by the elastic deformation section 23, the stopper member 18 attached to the inner end portion of the shaft section 16 of the operation member 12 comes in contact with the inner end surface of the small-diameter cylinder section 14*a* of the first cylinder section 14 of the cylindrical member 11, as shown in FIG. 2 to FIG. 4.

Moreover, when pressed toward the inside of the first case 2 by the head section 17 of the operation member 12 against the elastic force of the elastic deformation section 23, this elastic member 13 is elastically deformed such that the elastic deformation section 23 is pressed and deformed between the inner surface of the head section 17 and the inner surface of the second cylinder section 15.

By this elastic deformation of the elastic deformation section 23, the elastic member 13 allows the shaft section 16 of the operation member 12 to slide in the axial direction, which causes the inner end of the shaft section 16 to protrude in the first case 2, as shown in FIG. 2 to FIG. 4. By this protruding inner end of the shaft section 16, the switch element 24 of the timepiece module 7 described below is operated.

The switch element 24 of the timepiece module 7 is pressed by the inner end of the shaft section 16 pressed into the inside of the first case 2 and thereby outputs a switch signal, when the head section 17 is pressed and the shaft section 16 of the operation member 12 is slid inside the first case 2, as shown in FIG. 2 and FIG. 3.

On the elastic member 13, a plurality of shock buffering sections 25 are provided. These shock buffering sections 25 come in contact with a ring-shaped rim section 17*a* on the inner end of the head section 17 when the head section 17 of the operation member 12 is subjected to an external impact, as shown in FIG. 2 to FIG. 6. Note that the "impact" in the present embodiment refers to a pressure to the head section 17 which is greater than a minimum pressure required for the shaft section 16 of the operation member 12 to operate the switch element 24. The plurality of shock buffering sections 25 are made of the same elastic material as the elastic member 13, and provided on the second surface section 22 of the elastic member 13 at equal intervals along the circumferential direction.

After the elastic deformation section 23 of the elastic member 13 is elastically deformed by the head section 17 of the operation member 12 being subjected to an external impact and the switch element 24 is operated by the shaft section 16 of the operation member 12, the plurality of shock buffering sections 25 dissipate and buffer the external impact by the rim section 17*a* of the head section 17 being pressed against each shock buffering section 25, as shown in FIG. 2 to FIG. 6.

Figure 5:
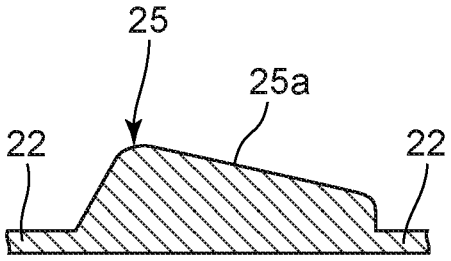
FIG. 5 is a sectional view of a shock buffering section of the elastic member taken along line A-A in FIG. 4.
Figure 6:
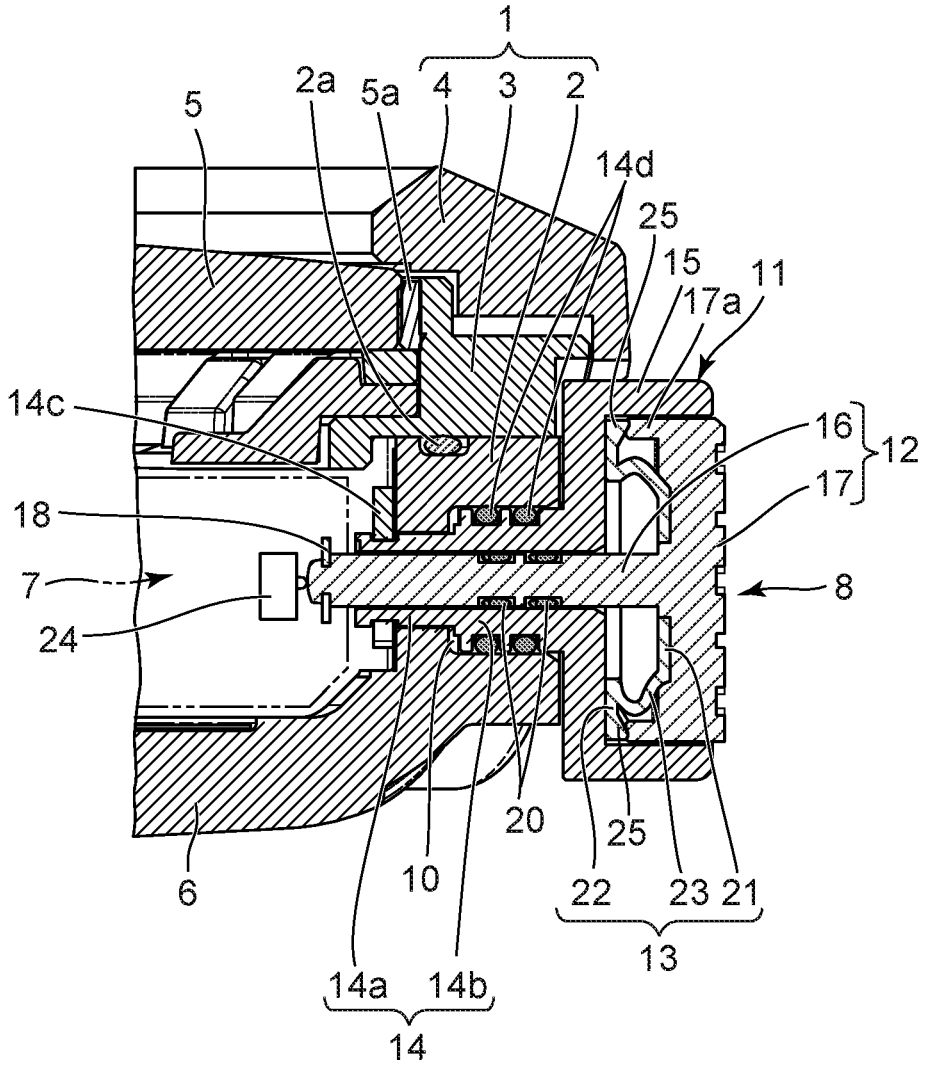
FIG. 6 is a sectional view where an impact has been exerted from outside on the operation member for the push button shown in FIG. 2.

In the present embodiment, the plurality of shock buffering sections 25 are formed in a shape by which the head section 17 is rotated in one direction, such as the clockwise direction, when an impact from the rim section 17*a* of the head section 17 is buffered, as shown in FIG. 4 to FIG. 6. More specifically, the upper surface of each shock buffering section 25 with which the rim section 17*a* of the head section 17 comes in contact is formed to be an inclined surface 25*a*.

Each inclined surface 25*a* is inclined such that each shock buffering section 25 becomes thicker toward its one end in the counterclockwise direction, and gradually becomes thinner toward its other end, as shown in FIG. 4 to FIG. 5. That is, the plurality of shock buffering sections 25 have a structure where the rim section 17*a* of the head section 17 is shifted along each inclined surface 25*a* when these shock buffering sections 25 are elastically deformed by the rim section 17*a* coming in contact therewith, whereby the head section 17 is rotated in the clockwise direction.

That is, when the plurality of shock buffering sections 25 are to be elastically deformed by the rim section 17*a* of the head section 17 coming in contact therewith, these shock buffering sections 25 displace the rim section 17*a* such that this rim section 17*a* is shifted from the thicker side of each shock buffering section 25 toward the thinner side thereof, and thereby rotate the head section 17 in the clockwise direction, as shown in FIG. 4 to FIG. 6.

Next, the mechanism and advantageous effects of the push button 8 of this wristwatch are described.

In the normal state of the push button 8, since the elastic deformation section 23 of the elastic member 13 has a cylindrical and circular truncated cone shape, the head section 17 of the operation member 12 is protruding outside the second cylinder section 15 of the cylindrical member 11 by the operation member 12 being pressed toward the outside of the wristwatch case 1 by the elastic force of the elastic member 13.

In this state, the stopper member 18 provided on the inner end portion of the shaft section 16 of the operation member 12 is in contact with the inner end of the small-diameter cylinder section 14*a* of the first cylinder section 14 of the cylindrical member 11. Accordingly, the inner end of the shaft section 16 of the operation member 12 is away from the switch element 24 of the timepiece module 7. As a result, the switch element 24 at this point is in the OFF state. Also, by the plurality of packing members 20 provided on the outer circumference surface of the shaft section 16, waterproofing is maintained between the outer circumference surface of the shaft section 16 and the inner circumference surface of the first cylinder section 14 of the cylindrical member 11.

In this state, when the head section 17 of the operation member 12 is pressed toward the inner side of the wristwatch case 1, the elastic deformation section 23 is pressed and elastically deformed. Here, this elastic deformation section 23 is elastically deformed in accordance with the pressure applied to the head section 17 as if it is pressed flat while bulging toward the outer circumference side.

As a result, the shaft section 16 of the operation member 12 is slid inside the first cylinder section 14 of the cylindrical member 11 so as to be pressed into the first case 2. Accordingly, the inner end of the shaft section 16 presses the switch element 24 of the timepiece module 7, so that the switch element 24 is operated. In this case as well, by the plurality of packing members 20 provided on the outer circumference of the shaft section 16, the waterproofing is maintained between the outer circumference surface of the shaft section 16 and the inner circumference surface of the first cylinder section 14.

On the other hand, when the head section 17 of the operation member 12 is subjected to an impact exerted from outside the wristwatch case 1, the rim section 17*a* provided on the inner end of the head section 17 comes in contact with the plurality of shock buffering sections 25 provided on the second surface section 22 of the elastic member 13. Here, these shock buffering sections 25 are elastically deformed so as to dissipate the external force, whereby the impact is unfailingly and favorably buffered.

When the impact exerted on the head section 17 is to be buffered as described above by the rim section 17*a* of the head section 17 coming in contact with the plurality of shock buffering sections 25, the rim section 17*a* of the head section 17 is rotated in one direction, which is the clockwise direction in the present embodiment, along each inclined surface 25*a* of the plurality of shock buffering sections 25. That is, each inclined surface 25*a* of the plurality of shock buffering sections 25 has been formed such that each shock buffering section 25 is thick at its one end in the counterclockwise direction, and is inclined to gradually become thinner toward its other end.

Accordingly, when each shock buffering section 25 is to be elastically deformed by the rim section 17*a* of the head section 17 coming in contact therewith, the rim section 17*a* is shifted from the thicker side of each shock buffering section 25 toward the thinner side thereof, whereby the head section 17 is rotated in the clockwise direction. By the head section 17 being rotated in one direction while elastically deforming the plurality of shock buffering sections 25, the impact exerted on the head section 17 is absorbed and favorably buffered.

Also, when the impact exerted on the head section 17 is to be buffered by the rim section 17*a* of the head section 17 coming in contact with the plurality of shock buffering sections 25, the inner end of the shaft section 16 is pressed into the first case 2 so that the switch element 24 of the timepiece module 7 is operated, and then further pressed into the first case 2 in accordance with the elastic deformation amount of each shock buffering section 25.

Here, since the impact is absorbed by the plurality of shock buffering sections 25 and the elastic deformation amount of each shock buffering section 25 is small as compared to that of the elastic deformation section 23, damage to the switch element 24 by the inner end of the shaft section 16 is small. As a result, the switch element 24 is prevented from being impaired by the inner end of the shaft section 16.

As described above, the push button 8 of this wristwatch includes the first case 2 of the wristwatch case 1 provided with the through hole 10, the operation member 12 having the shaft section 16 slidably inserted into the through hole 10 of the first case 2 and the head section 17 provided on the outer end of the shaft section 16, the substantially cylindrical elastic member 13 which presses the head section 17 toward the outside of the first case 2 or is elastically deformed in accordance with pressure applied to the head section 17, and the plurality of shock buffering sections 25 which are provided on the elastic member 13 and elastically deformed by coming in contact with the head section 17 when the head section 17 is subjected to an external impact. As a result of this structure, the shock resistance can be improved.

That is, when the head section 17 of the operation member 12 is subjected to an impact exerted from outside the wristwatch case 1, the rim section 17*a* provided on the inner end of the head section 17 comes in contact with the plurality of shock buffering sections 25 provided on the elastic member 13, and these shock buffering sections 25 are elastically deformed, so that the external force is dissipated.

As a result, by the plurality of shock buffering sections 25, the push button 8 can unfailingly and favorably absorb and buffer the impact exerted on the head section 17. As a result of this structure, the head section 17 of the operation member 12 and the switch element 24 in the timepiece module 7 can be prevented from being damaged by impacts, that is, the shock resistance can be improved.

Also, the first case 2 of the wristwatch case 1 is provided with the cylindrical member 11 having the first cylinder section 14 which is fitted into the through hole 10 and which the shaft section 16 is inserted into, and the second cylinder section 15 which is provided on the outer end of the first cylinder section 14 and which the elastic member 13 and the head section 17 of the operation member 12 are arranged in. As a result, by this cylindrical member 11, the operation member 12 can be slidably held stably, unfailingly and favorably.

That is, this push button 8 can be unfailingly and favorably slid with the shaft section 16 of the operation member 12 being stabilized by the first cylinder section 14 of the cylindrical member 11. In addition, by the second cylinder section 15 of the cylindrical member 11, the elastic member 13 can be unfailingly and favorably arranged with it being elastically deformable. Also, by this second cylinder section 15, the head section 17 can be slidably held and the shaft section 16 side of the head section 17 can be unfailingly and favorably drawn or retracted. Accordingly, the elastic member 13 can be elastically deformed by the head section 17 reliably and favorably.

Moreover, the elastic member 13 for this push button 8 is provided with the insertion hole 21*a* into which the shaft section 16 of the operation member 12 is inserted. In addition, this elastic member 13 has the discoid first surface section 21 which comes in contact with the inner surface of the head section 17 of the operation member 12, the second surface section 22 which comes in contact with the inner surface of the second cylinder section 15 of the cylindrical member 11, and the cylindrical elastic deformation section 23 which has a shape that gradually widens toward the second surface section 22 and connects the first surface section 21 and the second surface section 22. As a result, the elastic member 13 can be elastically deformed unfailingly and favorably when the head section 17 is pressed from outside.

More specifically, this push button 8 has the structure in which, when the head section 17 is pressed from outside, the elastic deformation section 23 is pressed by the head section 17 and elastically deformed in accordance with the pressure applied to the head section 17 as if it is pressed flat while bulging toward the outer circumference side. As a result of this structure, the user can favorably slide and press the shaft section 16 toward the inside of the first case 2 while elastically deforming the elastic deformation section 23 in accordance with the pressure applied to the head section 17.

Furthermore, in this push button 8, the plurality of shock buffering sections 25 are provided on the second surface section 22 of the elastic member 13. Accordingly, although the push button 8 is equipped with the plurality of shock buffering sections 25, the number of the components has been reduced and the assembly work therefor can be simplified. Also, when the head section 17 of the operation member 12 is subjected to an impact exerted from outside the wristwatch case 1, the rim section 17*a* of the head section 17 comes in contact with the plurality of shock buffering sections 25, whereby the impact exerted on the head section 17 can be dissipated and unfailingly and favorably buffered.

Still further, in this push button 8, the plurality of shock buffering sections 25 are provided on the second surface section 22 of the elastic member 13 at equal intervals along the circumferential direction. Accordingly, when the head section 17 of the operation member 12 is subjected to an impact exerted from outside the wristwatch case 1, the rim section 17*a* of the head section 17 comes in contact with and elastically deforms the plurality of shock buffering sections 25. As a result, the impact exerted on the head section 17 can be evenly dissipated in the circumferential direction of the second surface section 22 and thereby buffered.

Yet still further, when buffering an impact by coming in contact with the rim section 17*a* of the head section 17, the plurality of shock buffering sections 25 rotate the head section 17 in one direction which is the clockwise direction in the present embodiment. As a result of this structure, when an impact exerted on the head section 17 is to be buffered by the plurality of shock buffering sections 25, it can be more favorably buffered.

That is, each shock buffering section 25 has the inclined surface 25*a* which is provided along the circumferential direction of the second surface section 22 and used for rotating the head section 17 in one direction. Accordingly, when the rim section 17*a* comes in contact with the plurality of shock buffering sections 25 by the head section 17 being subjected to an impact, the head section 17 can be rotated along the inclination direction of each inclined surface 25*a* of the plurality of shock buffering sections 25.

More specifically, in order to rotate the head section 17 in one direction that is the clockwise direction, each inclined surface 25*a* of the plurality of shock buffering sections 25 are formed to be inclined such that each shock buffering section 25 is thick at its one end in the counterclockwise direction and gradually becomes thinner toward its other end. As a result, when the rim section 17*a* of the head section 17 comes in contact with the plurality of shock buffering sections 25 by the head section 17 being subjected to an impact, this rim section 17*a* of the head section 17 is shifted from the thicker side of each shock buffering section 25 toward the thinner side thereof.

By the rim section 17*a* of the head section 17 being shifted from the thicker side of each shock buffering section 25 toward the thinner side thereof, the plurality of shock buffering sections 25 can rotate the head section 17 in one direction that is the clockwise direction. As a result of this structure, in this push button 8, when the rim section 17*a* of the head section 17 comes in contact with the plurality of shock buffering sections 25 so as to buffer an impact exerted on the head section 17, the head section 17 is rotated in one direction that is the clockwise direction while the plurality of shock buffering sections 25 are being elastically deformed. By the head section 17 being rotated in one direction that is the clockwise direction, the impact exerted on the head section 17 can be favorably absorbed and buffered.

In the above-described embodiment, the cylindrical member 11 is provided in the through hole 10 in the first case 2 of the wristwatch case 1, and the operation member 12 is attached to this cylindrical member 11. However, the present invention is not limited thereto. For example, a structure may be adopted in which the operation member 12 is inserted into the through hole 30 provided in the first case 2, as shown in a first modification example in FIG. 7.

Figure 7:
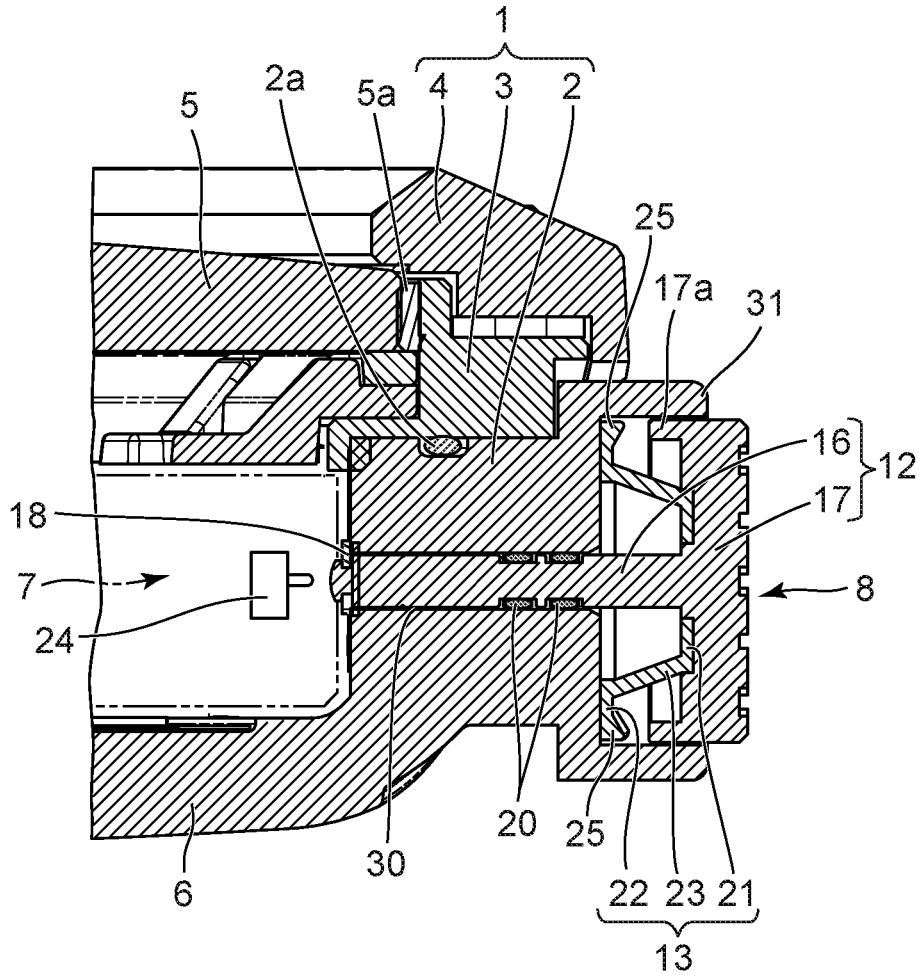
FIG. 7 is a sectional view of a first modification example of the wristwatch.

In this structure, the elastic member 13 is arranged on the outer surface of the first case 2, and a cylinder section 31 where the head section 17 of the operation member 12 is arranged is provided coaxially with the through hole 30, as shown in FIG. 7. By this structure of the first modification example as well, the same advantageous effects as the above-described embodiment can be acquired. In addition, since the cylindrical member 11 is not necessary, the number of the components can be reduced and the assembly work therefor can be simplified.

Also, in the above-described embodiment, the wristwatch case 1 is constituted by the first case 2, the second case 3, and the exterior member 4. However, the present invention is not limited thereto. For example, a structure may be adopted in which the wristwatch case 1 is constituted by a case main body and an exterior member, or by a case main body alone.

Moreover, in the above-described embodiment, the plurality of shock buffering sections 25 rotate the head section 17 in the clockwise direction. However, the present invention is not limited thereto. For example, a structure may be adopted in which the head section 17 is rotated in the counterclockwise direction. In this structure, the inclined surface 25*a* of each shock buffering section 25 is formed to be inclined such that each shock buffering section 25 is thick at its one end in the clockwise direction and becomes thinner toward its other end.

Furthermore, in the above-described embodiment, the plurality of shock buffering sections 25 rotate the head section 17 in one direction. However, the plurality of shock buffering sections 25 are not necessarily required to rotate the head section 17. For example, a plurality of shock buffering sections 35 shown in a second modification example in FIG. 8 and FIG. 9 may be formed.

Figure 8:
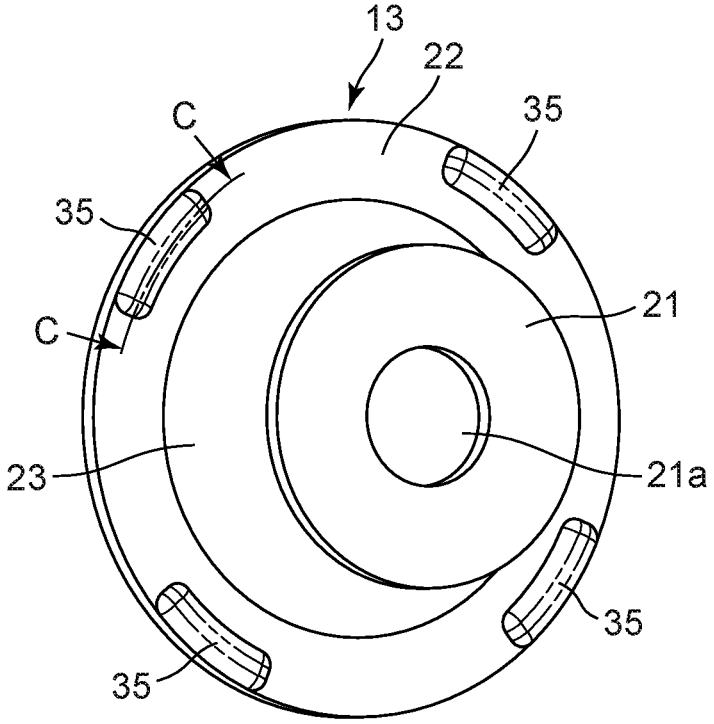
FIG. 8 is a perspective view of an elastic member for a push button in a second modification example.
Figure 9:
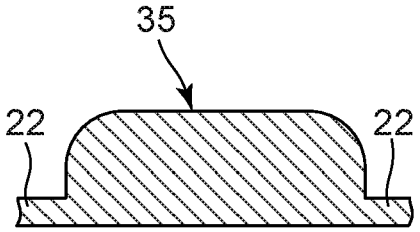
FIG. 9 is a sectional view of a shock buffering section of the elastic member taken along line C-C in FIG. 8.

More specifically, the shock buffering sections 35 of the second modification example are provided on outer circumference portions of the second surface section 22 of the elastic member 13 at equal intervals along the circumferential direction, as shown in FIG. 8 and FIG. 9. Each of these shock buffering sections 35 has a flat plate shape that is long along the circumferential direction and has an even thickness.

In the second modification example, when the head section 17 is subjected an impact and comes in contact with the plurality of shock buffering sections 35, the plurality of shock buffering sections 35 are elastically deformed in response to the impact exerted on the head section 17 such that each shock buffering section 35 is evenly compressed in the axial direction of the operation member 12. Accordingly, in the second modification example, when the head section 17 comes in contact with the plurality of shock buffering sections 35 by an impact, each shock buffering section 35 is elastically and evenly deformed in the thickness direction that is the axial direction of the operation member 12 without the head section 17 being rotated, whereby the impact exerted on the head section 17 is favorably absorbed and buffered.

In the above-described second modification example, each shock buffering section 35 is formed in a flat plate shape having an even thickness. However, the present invention is not limited thereto. For example, a structure may be adopted in which the plurality of shock buffering sections 35 have mountain-like cross-sectional shapes having equal heights, and each shock buffering section 35 is elastically and evenly deformed in response to an impact exerted on the head section 17, whereby the impact is buffered.

Also, the plurality of shock buffering sections 25 or 35 on the second surface section 22 of the elastic member 13 are not necessarily required to be provided in a separated state, and a ring-shaped shock buffering section extending on the second surface section 22 of the elastic member 13 along the circumferential direction may be provided.

Moreover, in the above-described embodiment and modification examples, the present invention has been applied in a wristwatch. However, the present invention is not necessarily required to be applied in a wristwatch. For example, the present invention is applicable to various types of timepieces such as a travel watch, an alarm clock, a table clock, and a wall clock. Furthermore, the present invention is not necessarily required to be applied in timepieces, and can be widely applied in electronic devices such as a portable telephone and a portable terminal device.

While the present invention has been described with reference to the preferred embodiments, it is intended that the invention be not limited by any of the details of the description therein but includes all the embodiments which fall within the scope of the appended claims.

What is claimed is:

1. A push button comprising:

a case provided with a through hole;

an operation member comprising:

a shaft section inserted into the through hole of the case; and a head section provided on an outer end of the shaft section; and an elastic member comprising:

a first surface section provided with an insertion hole into which the shaft section is inserted, wherein the first surface section comes in contact with an inner surface of the head section;

a second surface section that comes in contact with the case;

an elastic deformation section connecting the first surface section and the second surface section, wherein the elastic deformation section is configured to elastically deform in response to a pressure applied to the head section from outside and to press which presses the head section toward outside of the case; and a buffer section provided on the second surface section and configured to come in contact with the head section and be elastically deformed when the pressure applied to the head section from outside is greater than a predetermined pressure.

2. The push button according to claim 1, wherein the elastic member is formed in a substantially cylindrical shape.

3. The push button according to claim 1, wherein the buffer section is provided on an entire circumference of the second surface section, or is plurally provided thereon at intervals.

4. The push button according to claim 1, wherein the buffer section is plurally provided at intervals along a circumferential direction of the second surface section, and rotates the head section in one direction when the pressure greater than the predetermined pressure is applied to the head section.

5. The push button according to claim 4, wherein the buffer section has a surface inclined along the circumferential direction of the second surface section.

6. The push button according to claim 1, wherein the head section comprises a rim section provided on the inner surface of the head section, and wherein the buffer section is provided on the second surface section and configured to come in contact with the rim section when the pressure greater than the predetermined pressure is applied to the head section from outside.

7. The push button according to claim 2, wherein the head section comprises a rim section provided on the inner surface of the head section, and wherein the buffer section is provided on the second surface section and configured to come in contact with the rim section when the pressure greater than the predetermined pressure is applied to the head section from outside.

8. The push button according to claim 1, further comprising:

a cylindrical member comprising:

a first cylinder section which is fitted into the through hole and which the shaft section is inserted into; and a second cylinder section which is provided on an outer end of the first cylinder section and which the elastic member and the head section are arranged in.

9. The push button according to claim 2, further comprising:

a cylindrical member comprising:

a first cylinder section which is fitted into the through hole and which the shaft section is inserted into; and a second cylinder section which is provided on an outer end of the first cylinder section and which the elastic member and the head section are arranged in.

10. The push button according to claim 1, wherein the head section comprises a groove section provided on the inner surface of the head section, wherein the first surface section is arranged by being fitted into the groove section, and wherein a contact area of the head section and the first surface section is substantially same between when pressure is externally applied to the head section and when no pressure is applied thereto, and a contact area of the second cylinder section and the second surface section is substantially same between when pressure is externally applied to the head section and when no pressure is applied thereto.

11. The push button according to claim 1, wherein the pressure greater than the predetermined pressure is a pressure to the head section which is applied in a direction parallel to the shaft section and is greater than a minimum pressure required to operate the push button.

12. A timepiece comprising the push button according to claim 1.

13. A timepiece comprising the push button according to claim 2.

* * * * *